US006986217B2

(12) United States Patent
Leung et al.

(10) Patent No.: US 6,986,217 B2
(45) Date of Patent: Jan. 17, 2006

(54) HAND HELD GARMENT STEAMER

(75) Inventors: Anthony Kit Lun Leung, Hong Kong (CN); Chung Shun Tse, Hong Kong (CN)

(73) Assignee: Conair Corporation, Stamford, CT (US)

( * ) Notice: Subject to any disclaimer, the term of this patent is extended or adjusted under 35 U.S.C. 154(b) by 212 days.

(21) Appl. No.: 10/339,178

(22) Filed: Jan. 9, 2003

(65) Prior Publication Data

US 2004/0010950 A1 Jan. 22, 2004

Related U.S. Application Data

(60) Provisional application No. 60/347,178, filed on Jan. 9, 2002.

(51) Int. Cl.
*D06F 75/38* (2006.01)
*D06C 7/00* (2006.01)

(52) U.S. Cl. ..... 38/77.83; 68/222

(58) Field of Classification Search ..... 38/77.3, 38/77.7, 77.8, 77.83, 77.9, 81, 88, 93, 94, 38/97; 392/403; 68/222; 15/4, 5, 21.2, 15/104.02

See application file for complete search history.

(56) References Cited

U.S. PATENT DOCUMENTS

| | | | | |
|---|---|---|---|---|
| 2,849,736 A | | 9/1958 | Kohle | 15/133 |
| 3,620,055 A | | 11/1971 | Blachly et al. | 68/22 |
| 3,646,317 A | * | 2/1972 | Osrow | 392/337 |
| 3,675,449 A | | 7/1972 | Bluestein | 68/222 |
| 3,690,024 A | * | 9/1972 | Osrow | 38/69 |
| 3,742,629 A | * | 7/1973 | Plasko | 38/69 |
| 3,805,425 A | | 4/1974 | Spoida et al. | 38/69 |
| 3,811,208 A | | 5/1974 | Vieceli et al. | 38/77.8 |
| 3,969,607 A | | 7/1976 | Osrow et al. | 219/272 |
| 4,206,340 A | | 6/1980 | Osrow et al. | 219/272 |
| 4,571,483 A | | 2/1986 | Fathi | 219/271 |
| 4,640,028 A | * | 2/1987 | Nakada et al. | 38/77.7 |
| 4,833,298 A | | 5/1989 | Wilkins | 219/273 |
| 4,835,364 A | | 5/1989 | Wilkins | 219/273 |
| 4,843,215 A | | 6/1989 | Wilkins | 219/271 |
| 4,851,642 A | | 7/1989 | Wilkins | 219/275 |
| 4,855,568 A | | 8/1989 | Wilkins | 219/271 |
| 4,857,703 A | | 8/1989 | Wilkins | 219/271 |
| 5,121,464 A | | 6/1992 | Hanada et al. | 392/405 |
| 6,031,969 A | | 2/2000 | Burr et al. | 392/404 |
| 6,295,691 B1 | * | 10/2001 | Chen | 15/321 |
| 6,513,269 B2 | * | 2/2003 | Kobayashi et al. | 38/93 |
| 6,622,404 B2 | * | 9/2003 | Valiyambath | 38/96 |

FOREIGN PATENT DOCUMENTS

| | | |
|---|---|---|
| GB | 2 159 397 | 12/1985 |
| JP | 1-317499 | 12/1989 |
| JP | 2-136200 | 5/1990 |

* cited by examiner

*Primary Examiner*—Ismael Izaguirre
(74) *Attorney, Agent, or Firm*—Lawrence Cruz; Steven A. Garner

(57) ABSTRACT

A hand held appliance for use in applying steam to a garment or other item made of fabric includes a pump, a boiler and a switch. Power is applied through the switch to the pump. The pump pumps water from the water tank to the boiler. The water is converted to steam in the boiler and is expelled from the appliance through a set of nozzles. The appliance may include optional attachments for performing other operations on garments or fabric, for example, applying pressure, brushing, scrubbing or lint removal.

11 Claims, 4 Drawing Sheets

HAND HELD GARMENT STEAMER

This application claims the benefit of provisional application Ser. No. 60/347,178, filed on Jan. 9, 2002.

BACKGROUND OF THE INVENTION

1. Field of the Invention

The present invention relates to a hand held appliance for the care of garments and other items made of fabric. More particularly, the present invention relates to a hand held appliance for applying steam and/or heat to garments, fabrics and the like.

2. Description of the Prior Art

Portable hand held devices for applying steam are particularly useful in removing wrinkles and improving the appearance of hanging garments, draperies, upholstery, and other items made of fabric. When traveling, these devices may be especially effective for freshening clothes that have been packed in luggage. They are also useful for improving the appearance of hanging draperies without removing them, straightening and flattening upholstery, opening seams, and, generally, for smoothing fabric during sewing operations. In all of these applications, it is not only important to apply steam to the fabric, but to do so in a safe and easy manner. It is also important to be able to apply a desired amount of steam to a particular portion of the fabric being treated.

There are several factors that make the steaming operation difficult. An appliance that is large may occupy a significant amount of space rendering it unsuitable for use when traveling. An appliance that is bulky and heavy may be difficult to manipulate and thus inhibit applying the proper amount of steam for the time required to remove wrinkles. In addition, a bulky appliance may make it difficult to operate the controls. An appliance that does not accommodate different voltages encountered in different countries may be inconvenient. Also, the construction of the appliance may make filling with water difficult and may require a user to carry the entire appliance to a source of water. Certain types of fabric may also require an additional operation during the steaming operation such as the application of pressure over an area, brushing, or scrubbing.

Therefore, there exists a need for a hand-held garment steamer that is relatively lightweight, convenient to maneuver and operate, including filling the water tank thereof, and operable from multiple voltage sources.

SUMMARY OF THE INVENTION

It is an object of the present invention to provide a hand-held steamer for applying steam to an article of fabric construction.

It is another object of the present invention to provide such a steamer that is relatively lightweight and easy to hold.

It is yet another object of the present invention to provide such a steamer that applies steam and/or heat in a consistent manner.

It is a further object of the present invention to provide such a steamer that uses different voltages that may be found in various countries.

It is a still further object of the present invention to provide such a steamer having a detachable reservoir that is easily filled.

It is a still further object of the present invention to provide such a steamer with at least one attachment for performing operations on an item while steaming.

These and other objects and advantages of the present invention are achieved by a hand held appliance for use in applying steam to a garment or other article preferably made of fabric. Advantageously, the garment steamer of the present invention preferably is lightweight, comfortably held in the hand of a user, and suitably sized for easy, convenient transport such as traveling. The garment steamer of the present invention preferably includes functionality to provide a consistent application of steam and heat, either alone or in combination with the other, to an article of fabric construction and accommodates multiple voltage sources. A detachable reservoir is provided to facilitate easy filling thereof. The present invention preferably includes one or more attachments for performing various fabric treatment operations, such as but not limited to brushing, combing, flattening, and scrubbing fabric, and removing lint therefrom.

The steamer of the present application includes a pump, a steam generator or boiler, a steam discharge switch, and a removable water tank or reservoir. Power is selectively applied through a steam discharge switch to the pump. The pump pumps water from the reservoir to the boiler. The water is converted to steam in the boiler. The steam is discharged from the steamer through a number of openings disposed in an outer surface of a head portion of the steamer. The steamer preferably has a soleplate that is heated for applying heat to an article of fabric.

DETAILED DESCRIPTION OF THE INVENTION

Figure 1:
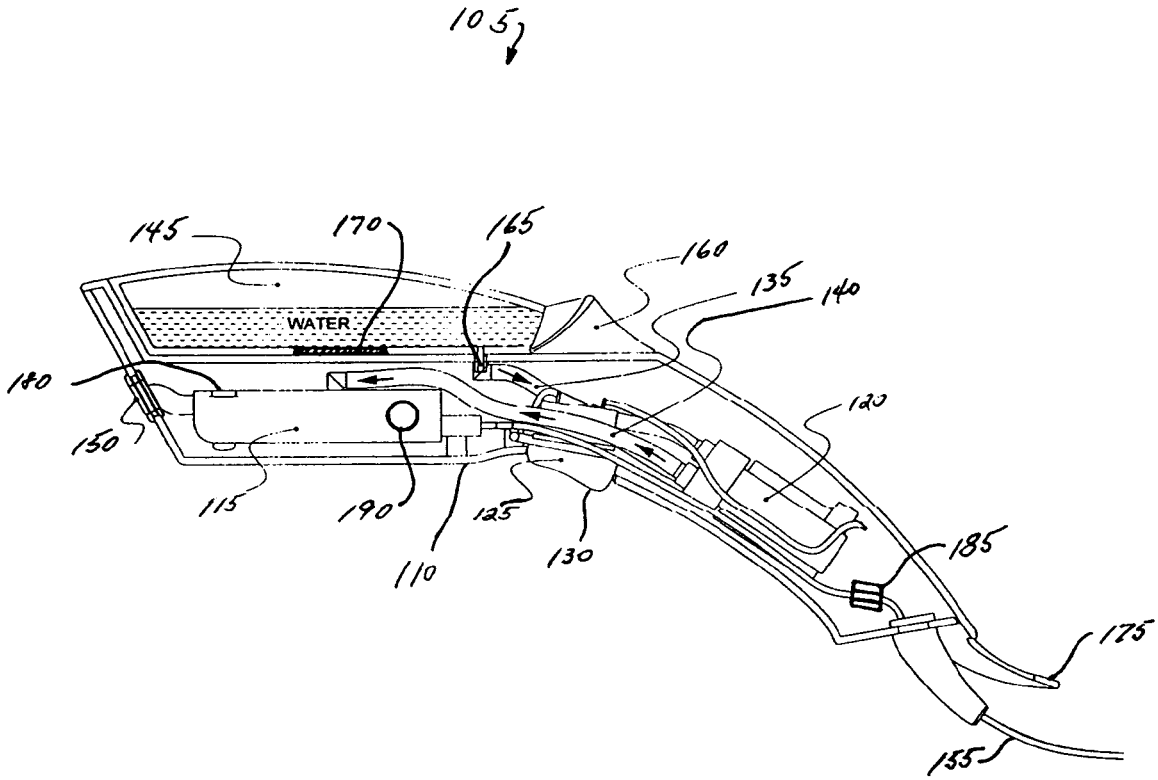
FIG. 1 is a side view of a garment steamer accordance with the present invention.

Referring to the figures and, in particular, FIG. 1, there is shown a hand held garment steamer generally represented by reference numeral 105.

Steamer 105 has a housing 110 that houses, and preferably encloses, a boiler 115 and a pump 120. Housing 110 has a nozzle 150 at a head portion end thereof and a handle connected to and extending from the head portion. A steam discharge switch 125 is mounted in or to housing 110 with its actuator 130 protruding through an opening in housing 110.

A first water pipe 135 is provided to convey water from water tank or reservoir 145 to a pump 120. A second water pipe 140 conveys water from pump 120 to a boiler 115. In boiler 115, the water is heated from a liquid state to steam. It should be appreciated that the boiler may be varied to include any type of steam generator compatible with the other aspects of the present invention.

The steam generated in boiler 115 is discharged (i.e., expelled) from at least one, and preferably a number of, nozzles 150 located on at least one outer surface of the head portion of steamer 105.

Power for steamer 105 is derived from an external power source (not shown) through an electrical cable 155. Cable 155 provides an electrical connection from the external power source to pump 120, boiler 115, and other components of steamer 105 requiring electrical energy. It should be appreciated by those skilled in the art that steamer 105 may be powered by an internal power source such as a battery.

Reservoir 145 is preferably detachable (i.e., removable) from housing 110. In a preferred embodiment, reservoir 145 is connected to steamer 105 at the head portion end of the steamer. Reservoir 145 is selectively released by actuation of a reservoir release button 160.

Upon detachment from housing 110, reservoir 145 may be conveniently filled with a liquid such as water. Reservoir 145 may be filled through a fill port 165 that optionally includes valving to prevent spillage while water tank 145 is disengaged from housing 110. Water tank 145 may be filled through another port or cap, an example of which is shown as filler cap 170.

In an aspect of the present invention, reservoir 145 is preferably at least partially translucent to facilitate a visual determination of the amount of water contained present in reservoir 145.

Once filled, water tank can be connected to housing 110 so that port 165 engages with first water pipe 135. First water pipe 135 provides a conduit for liquid transport between reservoir 145 and pump 120. Pump 120 is an electrical pump and can be a rotary vane, peristaltic, or any other type of pump suitable for pumping liquid according to the teachings of the present invention.

In an aspect of the present invention, pump 120 may operate at a fixed voltage or over a number of different voltages. For instance, pump 120 may operate only at 115 VAC or a multitude of voltages common to different countries. Preferably, the accommodated voltages have a range about 100 VAC to about 230 VAC.

Electrical cable 155 provides electrical power to housing 110 and, in particular, to pump 120 through a steam discharge switch 125. Cable 155 may also have at least one safety device 185 in the form of a fuse, circuit breaker, thermal cut-off, or other safety device appropriate for use in the steamer of the present invention.

Upon actuation, steam discharge switch 125 serves to complete an electrical circuit including pump 120 and cable 155, either directly or indirectly, for example by use of a relay. Thus, steam discharge switch 125 operates to cause the application of electrical power to pump 120.

In another aspect of the present invention, steam discharge switch 125 may operate to cause a variable amount of power to be applied to pump 120 depending upon the amount of actuation by a user. In one aspect, steam discharge switch 125 may be locked or fixed in position to cause a constant amount of electrical power to be applied to pump 120 without further actuation by a user.

Second water pipe 140 provides a conduit from pump 120 to the steam generator (e.g., boiler 115). Upon application of power from steam discharge switch 125, pump 120 pumps (i.e., draws) water from reservoir 145 through first water pipe 135 and pumps water through second water pipe 140 to boiler 115.

Cable 155 also provides electrical power to boiler 115. In an aspect hereof, boiler 115 receives electrical power so long as cable 155 is plugged into a suitable source of electrical power. In another aspect hereof, boiler 115 receives electrical power through steam discharge switch 125, and thus may receive variable or constant power according to the configuration of switch 125.

Boiler 115 uses the electrical power to produce heat for converting the water pumped from reservoir 145 to steam. Boiler 115 may be a "flash" boiler, capable of producing steam almost instantaneously upon the introduction of water from second water pipe 140. Boiler 115 can include a safety device in the form of a thermal cut-off 180 (or any other applicable safety device) to prevent overheating of the boiler.

In a manner similar to pump 120, boiler 115 may operate at a fixed voltage (e.g., 115 VAC) or over a number of different voltages that may be found in different countries (e.g., a range of about 100 VAC to about 230 VAC).

In another aspect of the present invention, a number of attachments may be mounted onto the steamer. The attachments are preferably connected to the head portion of the steamer and cover, at least partially, a surface face area of the head portion. The attachments aid in the steaming and/or fabric treatment processes being performed on a particular article of fabric.

Figure 2:
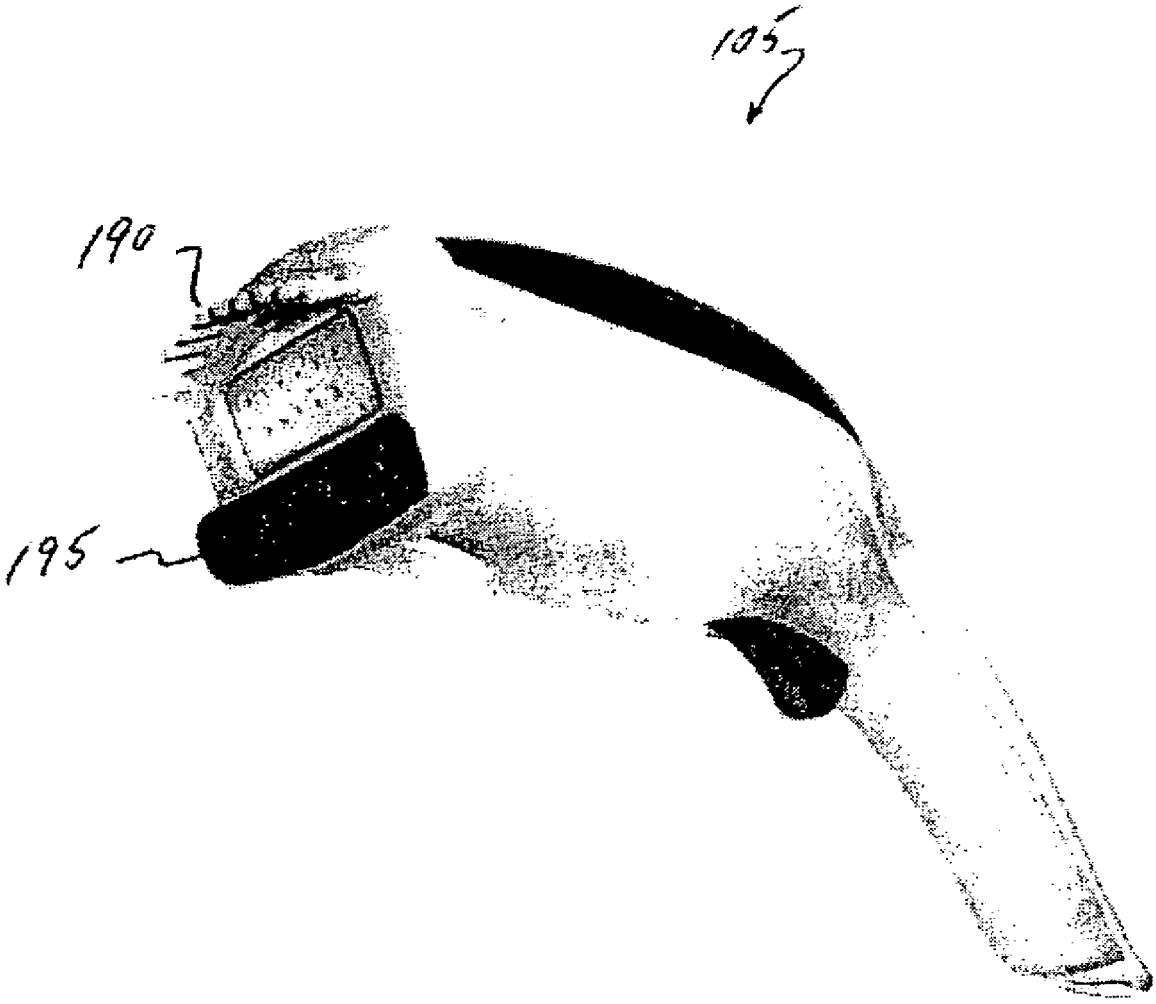
FIG. 2 is a perspective view of the appliance of FIG. 1, including an attachment attached thereto in accordance with the present invention.

FIG. 2 shows an attachment including brush attachment 190 and a lint remover attachment 195. Brush attachment 190 and lint removing attachment 195 may be used individually, together, or in any combination with the steaming capability of the steamer 105. It should be appreciated that other attachments, such as a comb, fabric pill remover, etc. are within the scope, and thus covered by the present invention.

Figure 3:
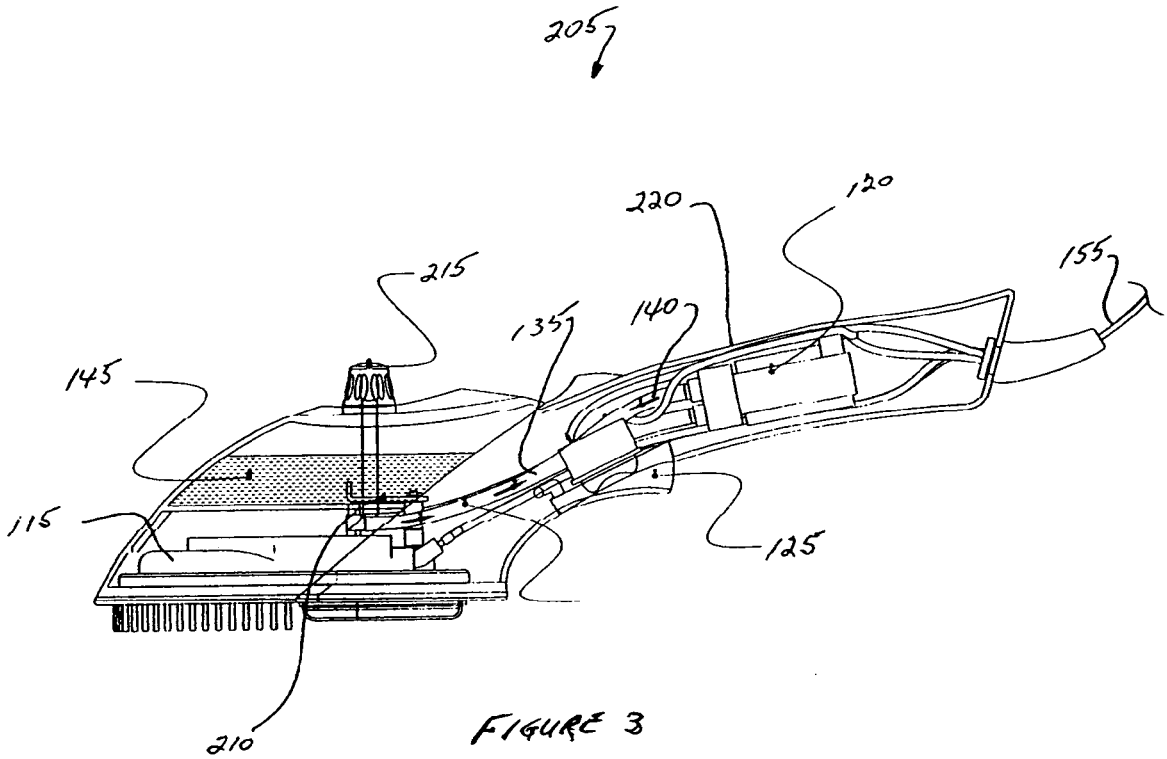
FIG. 3 is a side view of a garment steamer in accordance with another embodiment of the present invention.

FIG. 3 shows another embodiment of the steamer of the present invention and is generally represented by the reference numeral 205. Although the configuration of housing 220 differs from the steamer of FIG. 1, both steamer 205 and housing 220 preferably function in a manner similar to as steamer 105 and housing 110, respectively, of FIG. 1. Boiler 115 of appliance 205 can be regulated by a thermostatic device 210 to control production of steam at a particular range of temperature and delivery rate. A temperature dial 215 may be connected to thermostatic device 210 for selection of a particular steam temperature.

Figure 4:
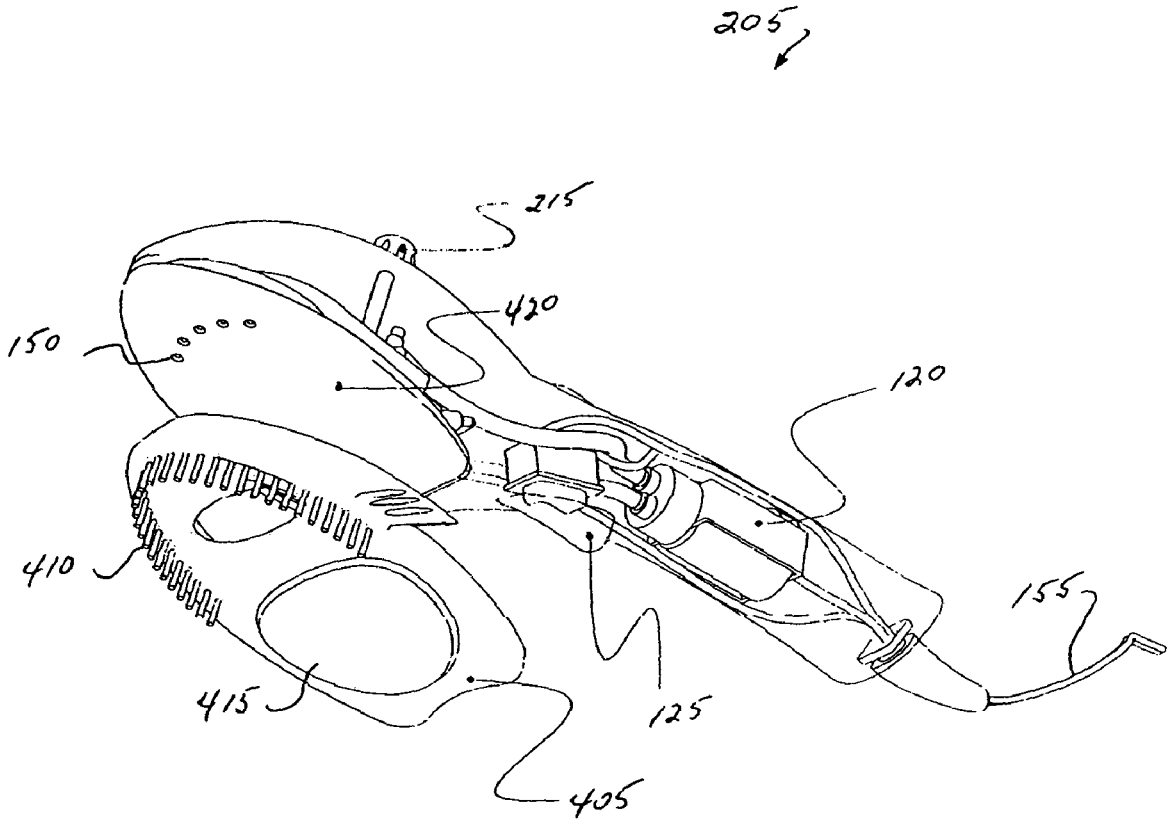
FIG. 4 is a perspective view of the appliance of FIG. 3 illustrating, inter alia, the soleplate thereof.

FIG. 4 shows an attachment 405 with a brush attachment 410 and lint remover attachment 415, both preferably incorporated into a single attachment 405.

Appliance 205 has a soleplate 420 that facilitates applying pressure and heat to the article of fabric being treated with the steamer of the present invention. Soleplate 420 has nozzles 150 disposed therein. It should be appreciated that soleplate 420 can be made of metal or any other suitable, preferably heat conductive, material for providing an even heat distribution to an article of fabric.

It should also be appreciated by those skilled in the art that the particular garment steamer functions and other aspects of the teachings herein are but examples of the present invention. Thus, they do not limit the scope or variety of applications that the present invention may be suitably implemented. Thus, it should be understood that the foregoing description is only illustrative of a present implementation of the teachings herein. Various alternatives and modification may be devised by those skilled in the art without departing from the present invention. Accordingly, the present invention is intended to embrace all such alternatives, modifications, and variances that fall within the scope of the disclosure herein.

What we claim is:

1. A hand-held garment steamer comprising a head portion;

an elongated handle being connected to and extending from said head portion;

a soleplate being disposed on an outer surface of said head portion, said soleplate having a heat conductive surface;

a reservoir for containing liquid therein, said reservoir being attached to said head portion;

a steam generator, in fluid communication with said reservoir, for generating steam from said liquid contained in said reservoir;

a plurality of apertures being disposed in said soleplate and in communication with said steam generator for facilitating a discharge of the steam generated by said steam generator from said steamer; and an attachment removably connected to said head portion and covering, at least partially, said soleplate.

2. The steamer of claim 1, wherein said attachment is selected from the group consisting of a fabric brush, a fabric comb, a lint remover, and any combinations thereof.

3. A hand-held garment steamer comprising a head portion;

an elongated handle being connected to and extending from said head portion;

a soleplate being disposed on an outer surface of said head portion, said soleplate having a heat conductive surface;

a reservoir for containing liquid therein, said reservoir being attached to said head portion;

a steam generator, in fluid communication with said reservoir, for generating steam from said liquid contained in said reservoir; and a plurality of apertures being disposed in said soleplate and in communication with said steam generator for facilitating a discharge of the steam generated by said steam generator from said steamer, wherein said reservoir is removably connected to said head portion.

4. The steamer of claim 3, further comprising a reservoir release for selectively releasing said reservoir from said head portion.

5. The steamer of claim 3 further comprising a reservoir release for selectively releasing said reservoir from said head portion.

6. The steamer of claim 5, wherein said thermostatic control includes a manually adjusted control.

7. A hand-held garment steamer comprising:

a head portion:

an elongated handle being connected to and extending from said head portion;

a soleplate being disposed on an outer surface of said head portion, said soleplate having a heat conductive surface;

a reservoir for containing liquid therein, said reservoir being attached to said head portion;

a steam generator, in fluid communication with said reservoir, for generating steam from said liquid contained in said reservoir;

a plurality of apertures being disposed in said soleplate and in communication with said steam generator for facilitating a discharge of the steam generated by said steam generator from said steamer; and a thermostatic control for controlling a temperature range at which said steam is generated wherein said thermostatic control controls a rate of delivery for said generated steam.

8. The steamer of claim 7 wherein said thermostatic control controls a rate of steam generation for said generated steam.

9. A hand-held garment steamer comprising:

a head portion;

an elongated handle being connected to and extending from said head portion;

a soleplate being disposed on an outer surface of said head portion, said soleplate having a heat conductive surface;

a reservoir for containing liquid therein, said reservoir being attached to said head portion;

a steam generator, in fluid communication with said reservoir, for generating steam from said liquid contained in said reservoir;

a plurality of apertures being disposed in said soleplate and in communication with said steam generator for facilitating a discharge of the steam generated by said steam generator from said steamer; and a heat shield for removable attachment to said soleplate, said heat shield being resistant to conducting heat from said soleplate.

10. A hand-held garment steamer comprising:

a head portion;

an elongated handle being connected to and extending from said head portion;

a soleplate being disposed on an outer surface of said head portion, said soleplate having a heat conductive surface;

a reservoir for containing liquid therein, said reservoir being attached to said head portion;

a steam generator, in fluid communication with said reservoir, for generating steam from said liquid contained in said reservoir; and a plurality of apertures being disposed in said soleplate and in communication with said steam generator for facilitating a discharge of the steam generated by said steam generator from said steamer;

wherein said steamer is operable by at least two power supplies having differing voltage outputs.

11. A hand-held garment steamer comprising:

a head portion;

an elongated handle being connected to and extending from said head portion;

a soleplate being disposed on an outer surface of said head portion, said soleplate having a heat conductive surface;

a reservoir for containing liquid therein, said reservoir being attached to said head portion;

a steam generator, in fluid communication with said reservoir, for generating steam from said liquid contained in said reservoir; and a plurality of apertures being disposed in said soleplate and in communication with said steam generator for facilitating a discharge of the steam generated by said steam generator from said steamer; and a steam discharge actuator for selectively controlling the discharge of the steam from said steamer wherein said discharge actuator is disposed on said handle.

* * * * *